US006008726A

United States Patent [19]

Hagen

[11] Patent Number: 6,008,726

[45] Date of Patent: Dec. 28, 1999

[54] ALARM FOR CARD OPERATED LOCKS WITH LOCAL RESET

[75] Inventor: Ketil Hagen, Väler, Norway

[73] Assignee: VingCard AS, Norway

[21] Appl. No.: 09/032,857

[22] Filed: Mar. 2, 1998

[30] Foreign Application Priority Data

Mar. 4, 1997 [NO] Norway ..... 970984

[51] Int. Cl.[6] ..... E05B 45/06

[52] U.S. Cl. ..... 340/543; 70/43.9; 340/542

[58] Field of Search ..... 340/543, 542; 70/439

[56] References Cited

U.S. PATENT DOCUMENTS

| | | | |
|---|---|---|---|
| 4,438,426 | 3/1984 | Adkins | 340/543 |
| 4,742,327 | 5/1988 | Burgess et al. | 340/543 |
| 5,041,814 | 8/1991 | Lin . | |
| 5,132,667 | 7/1992 | Cranford | 340/542 |
| 5,311,168 | 5/1994 | Pease, Jr. et al. | 340/542 |
| 5,577,408 | 11/1996 | Roos | 70/370 |

FOREIGN PATENT DOCUMENTS

| | | |
|---|---|---|
| 625590 | 9/1981 | Switzerland . |
| 1316973 | 5/1973 | United Kingdom . |
| 2286423 | 8/1995 | United Kingdom . |

*Primary Examiner*—Glen Swann
*Attorney, Agent, or Firm*—Bierman, Muserlian and Lucas

[57] ABSTRACT

An alarm device for a lock which provides a security system which displays unauthorized tampering with the lock. The device senses unauthorized movement of one or several elements in the lock and causes an alarm signal which may only be terminated by resetting the device by authorized operation of the lock.

6 Claims, 1 Drawing Sheet

ALARM FOR CARD OPERATED LOCKS WITH LOCAL RESET

TECHNICAL FIELD

The present invention relates to a device for locking means, particularly an alarm device, or an alarm system.

The invention relates in general to door locks, but particularly to door locks which operate with a code written on cards, e.g., in the form of a pattern of holes, magnetic spots, or similar, i.e., so-called card operated locks. The system or the device is not restricted thereto, it also being applicable for conventional mechanical locks if they additionally are equipped with an electrical power source and a signal transmitter means.

BACKGROUND OF THE INVENTION

For the time being, it is common to provide card operated locks with an emergency opening mechanism. This is a demand from some users and often from the fire department. The fire authorities will in some cases and in some fields of applications, e.g., hotels, often demand a mechanical opening possibility which is simple and well known, and which overrides card readers and electronics.

This emergency opening is often made as a lock cylinder of a known conventional type. In hotels, this lock cylinder is often a type which is relatively difficult to pick, but which can be opened with a main key, a so-called master key or floor key.

Such a system has weak points which are hard to avoid. Because no chain is stronger than the weakest joint, it follows that the possibility to pick the lock, which is very low for the card reader, is put back to "old fashion" level for the emergency opening mechanism. Several picking methods are experienced. In some cases the burglar has had success in picking the lock cylinder, or at least in attempting to pick it. However, in several cases the following method is used: a burglar rents a room in the hotel in a legal manner. During the night he removes the lock cylinder and replaces it with another with the same appearance. The staff will not notice this, because this emergency opening is never or very rarely used. The burglar can then bring the lock cylinder to his home and undisturbed analyse it and determine the shape of the master key. He may then visit the hotel, and by use of this key he is able to make to lot of damage by stealing from the rooms. The hotel will be forced to replace all compromised lock cylinders.

RELATED ART

Several attempts to avoid this problem have been made. There is referred to U.S. Pat. No. 5,577,408 or the corresponding Norwegian patent 178 639, which illustrates a mechanical way to confine the possibilities for removal of the lock cylinder. There are two major disadvantages related to this solution, firstly, a locksmith who has access to the room must be able to remove the lock cylinder, and secondly, it will always be possible to pick mechanical lock cylinders, and by means of the so-called "impression" method it is possible to determine the code for the key without dismantling the lock cylinder.

Further, from GB 1316973, CH 625590 and CB 2286423 it is known to provide lock cylinders with sensing means which detect attempts to pick the lock according to different picking methods.

Still further, from U.S. Pat. No. 5,041,814, it is known to provide lock cylinders with sensing means which detect unauthorized removal or swapping of the lock cylinder, which would cause trigging of the alarm.

When an alarm is triggered in one of these known designs, it is assumed that the system has to be reset by means of a device which is separated from the lock, or by a difficult and time consuming procedure on the lock alarm itself. This is not described in detail in the above mentioned patent publications, but it is common to provide such systems with a centrally placed, key operated device, for resetting of the alarm. Such systems demand however cabling from the movable door to a means which is placed outside the lock and door.

The above known, described methods and designs have all different deficiencies associated with the reset of the alarm, either by cabling from the door leaf to the fixed wall, or by a complicated device in the door itself.

SUMMARY OF THE INVENTION

The aim for present invention is to remedy the above mentioned weaknesses by means of a simple system which may be designated as a lock alarm system.

Mainly, a device according to the invention will comprise means which sense unauthorized movement of one or several elements in the lock, which are disposed to cause an alarm signal which may only be suspended by authorized operation of the lock.

More particular, the invention relates to that the sensing means are disposed for sensing movement of one or several elements which are included in an emergency opening mechanism.

In one particular embodiment, the device is characterized in that the sensing means are disposed for sensing movement of a lock cylinder.

Further features and advantages of the present invention will be apparent from the following description, taken in consideration together with the attached Figures, as well as from the attached patent claims.

BRIEF DESCRIPTION OF THE DRAWINGS

FIG. 2 is a side view, partially in section, of the lock shown in FIG. 1, mounted in a door leaf or similar.

DETAILED DESCRIPTION OF EMBODIMENTS

Figure 1:
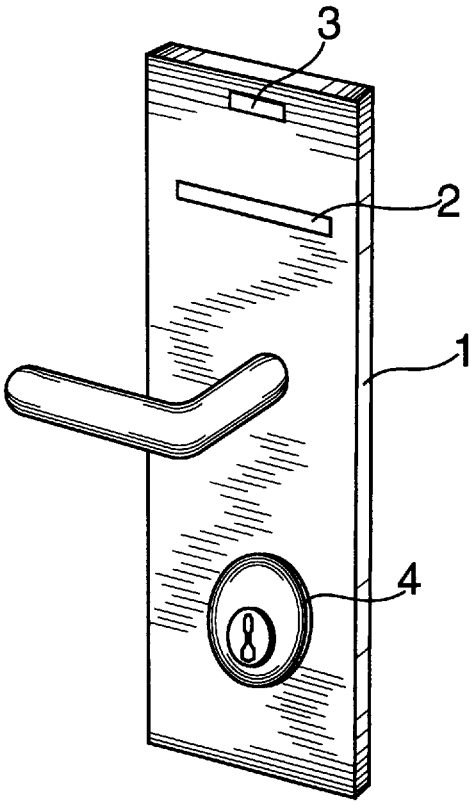
FIG. 1 is a perspective view of the front of an embodiment of a lock, where the device according to the invention may be applicable.

The present invention disclosures a system to solve the problems mentioned in the description of prior art. In connection with card operated locks, it is preferable to avoid cable routing from the lock to places outside the door leaf. The lock should preferably exist as an autonomous unit with its own built in power supply.

Further it is preferred that the alarm from the lock may be reset by means of an especial reset card, which may be used in the normal card insert gap. An alarm card which only few, authorized persons have access to, an more specific a card with a code which can be altered periodical if desired.

The present invention generally relates to a device for a lock, in particular an alarm device, which is characterized in that the device comprises means which sense unauthorized movement of one or several elements in the lock, which are disposed to cause an alarm signal which may only be reset by authorized operation of the lock.

Further features for the invention may be listed as in the following:

the sensing means are disposed for sensing movement of one or several elements which is/are included in an emergency opening mechanism, the sensing means are disposed for sensing movement of a lock cylinder the sensing means are connected to an electronic circuit which when receiving an alarm signal transmits this further to a visual indicator and/or a central in the building in which the lock is mounted, the sensing means are disposed for being reset, respectively have their alarm signal stopped by means of a communication means being specific for an authorized person, which may be used by authorized operation of said lock elements, and the communication means has the form of a special reset card, particularly a punch card or a magnetic card, alternatively have the shape of a keyboard belonging to the lock, alternatively have the shape of a preferably portable computer with associated light detector/light transmitter, for communication with the electronic circuits in the lock.

Related to one embodiment of a lock comprising an emergency lock in the form of a lock cylinder, one example of application of the invention is as follows.

The lock cylinder is inside the lock case connected to an electronic indicator which will register all turning movements of the lock cylinder, as well as other movements which displaces its vital parts or elements in the space. When such an indication occurs e.g. a flashing red light will, by means of electronic circuits which are not described herein, become visible on the front of the lock facing towards the corridor. Most card operated locks are today provided with a light emitting diode (LED) which will display a green light when a card is used correctly, and a red signal when a card is used in a wrong way. They are also provided with electronic circuits which would be capable to handle this extra function without large extra costs.

When an emergency opening cylinder has been touched or shifted in one way or another, special means in the lock will display this by means of a flashing red light which will operate as long as the electrical power source functions, and this light will be easily seen by the staff upon ordinary walking in the corridor. The signal may of course be supervised from a central in another way, e.g., by means of cabling, video or similar.

When authorized use of the alarm system occurs, the alarm system can be stopped by, e.g. a special reset card, i.e. an off-position card, which is available only for authorized staff. This reset card must of course be kept in a secure place, and in another place than the emergency keys.

In this way the authorized staff will be able to use the emergency key without triggering a permanent alarm. This is an alarm which although it is recorded, will be terminated at once. Unauthorized persons, which use the emergency key, or make attempts to pick the lock or emergency opening mechanism will trip the alarm. The system demands secure storage of the reset card.

Figure 2:
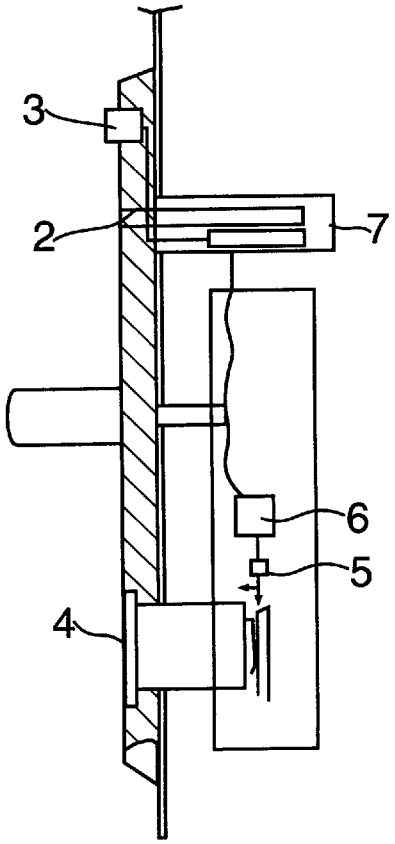

An example of an embodiment of the system described is shown in the FIGS. 1 and 2.

FIG. 1 shows the outside of the door lock faced against the corridor, with a sign 1, a card reader gap 2 and a light emitting diode 3.

An emergency opening mechanism 4 is here shown as a standard lock cylinder, but it could be formed in another way, e.g. as a window which must be smashed or similar.

FIG. 2 shows a sectional view, vertically through lock case and sign where an indicator 5 may be a magnetic sensor, micro switch, optical eye or something else. The indicator 5 is connected with control electronics 6, which further is connected with a card reader 7 and the light emitting diode 3. Resetting of the alarm is done via the card reader gap 2.

I claim:

1. An alarm device for a locking means which comprises:

sensing means for sensing unauthorized movements of one or several elements in the locking means, and in response thereto causing an alarm signal; and resetting means which only allows termination of the alarm signal by authorized operation of the locking means.

2. The device of claim 1 wherein the resetting means is adapted to reset the sensing means and stop the alarm signal, and comprises a specific communication means for an a authorized person, which may be used for authorized operation of said locking means.

3. The device of claim 1 wherein the resetting means is selected from the group consisting of a specific reset card, a keyboard belonging to the locking means, a portable computer with associated light detector/light transmitter, for communication with the lock means.

4. The device of claim 1 wherein the sensing means is disposed for sensing movement of an emergency opening mechanism.

5. The device of claim 1 wherein the sensing means is disposed for sensing movement of a lock cylinder.

6. The device of claim 1 wherein the sensing means is connected to an electronic circuit which when receiving an alarm signal transmits this further to a visual indicator and/or a central in the building in which the locking means is mounted.

* * * * *

UNITED STATES PATENT AND TRADEMARK OFFICE

CERTIFICATE OF CORRECTION

PATENT NO : 6,008,726

DATED : Dec. 28, 1999

INVENTOR(S) : Ketil Hagen

It is certified that error appears in the above-identified patent and that said Letters Patent is hereby corrected as shown below:

Column 4, line 39 (claim 3), change "lock" to --locking--.

Signed and Sealed this

Twelfth Day of December, 2000

*Attest:*

*Attesting Officer*

Q. TODD DICKINSON

*Director of Patents and Trademarks*